US005253478A

United States Patent [19]

Thibault, Jr. et al.

[11] Patent Number: 5,253,478

[45] Date of Patent: Oct. 19, 1993

[54] FLAME HOLDING DIVERGING CENTERBODY CUP CONSTRUCTION FOR A DRY LOW NOX COMBUSTOR

[75] Inventors: Bernard A. Thibault, Jr., Clifton Park; Elizabeth B. Beaudoin, Schenectady, both of N.Y.

[73] Assignee: General Electric Company, Schenectady, N.Y.

[21] Appl. No.: 813,745

[22] Filed: Dec. 30, 1991

[51] Int. Cl.[5] ..... F02C 3/00; F23R 3/08

[52] U.S. Cl. ..... 60/733; 60/747; 60/748; 60/753

[58] Field of Search ..... 60/747, 733, 737, 748, 60/732, 746, 755, 757

[56] References Cited

U.S. PATENT DOCUMENTS

| | | | |
|---|---|---|---|
| 2,627,721 | 2/1953 | Rosenlund . | |
| 2,933,888 | 4/1960 | Africano et al. . | |
| 2,951,339 | 9/1960 | Benson | 60/747 |
| 3,713,588 | 1/1973 | Sharpe . | |
| 3,853,273 | 12/1974 | Bahr et al. | 60/748 |
| 4,058,977 | 11/1977 | Markowski et al. | 60/733 |
| 4,292,801 | 10/1981 | Wilkes et al. . | |
| 4,754,600 | 7/1988 | Barbier et al. . | |
| 4,944,149 | 7/1990 | Kuwata . | |
| 4,949,538 | 8/1990 | Iasillo et al. . | |
| 4,974,416 | 12/1990 | Taylor | 60/748 |
| 4,982,570 | 1/1991 | Waslo et al. | 60/733 |
| 4,984,429 | 1/1991 | Waslo et al. | 60/752 |
| 5,030,871 | 7/1991 | Shah et al. . | |
| 5,054,280 | 10/1991 | Ishibashi et al. | 60/39.06 |

FOREIGN PATENT DOCUMENTS

| | | | |
|---|---|---|---|
| 626436 | 11/1981 | Fed. Rep. of Germany . | |
| 0239462 | 9/1987 | France . | |
| 742990 | 1/1956 | United Kingdom . | |
| 2072827 | 10/1981 | United Kingdom | 60/747 |
| 2134243A | 8/1984 | United Kingdom . | |

OTHER PUBLICATIONS

"Gas Turbine Combustion and Emissions", Gas Turbine Reference Library, Dr. L. B. Davis, Jr., GE Company. (no date)

"General Electric Gas Turbine Multiple-Combustion System", Gas Turbine Reference Library, GER-3435 Edward J. Walsh, GE Company, 1984.

"Dry Low NOx Combustion System for Utility Gas Turbine", AMSE, 83-JPGC-GT-13 R. M. Washam, GE Company 1983.

"Development of a Dry NOx Combustor", AMSE 89-GT-255 Davis & Washam, GE Company, Jun. 1989.

Branat, Donald E. "Design and Engine Reliability", Turbomachinery International, Jun. 1990, pp. 15-21.

*Primary Examiner*—Richard A. Bertsch
*Assistant Examiner*—Timothy S. Thorpe
*Attorney, Agent, or Firm*—Nixon & Vanderhye

[57] ABSTRACT

A centerbody cup construction for use in a dry low NOx gas turbine combustor includes a pair of inner and outer generally cylindrical members, the inner member having a diverging cup portion attached to its forward end extending toward the outer cylindrical member, and a coolant manifold arranged between the inner and outer cylindrical members radially adjacent the centerbody cup portion.

20 Claims, 6 Drawing Sheets

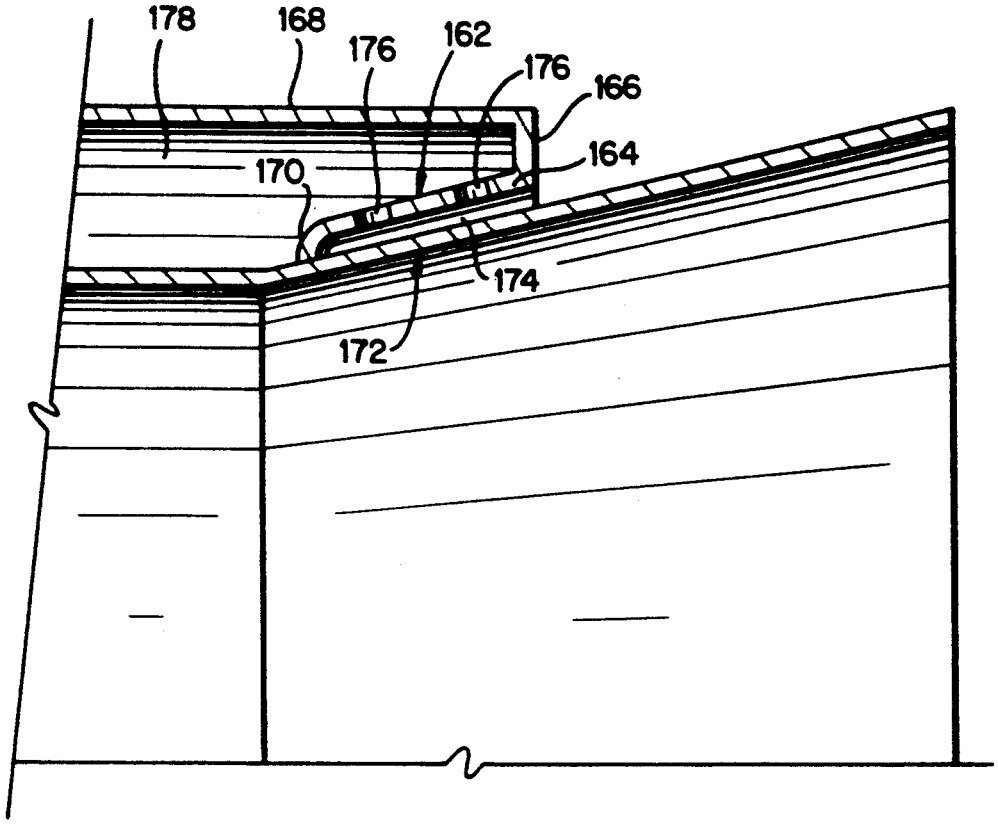
FIG. 5
FIG. 6
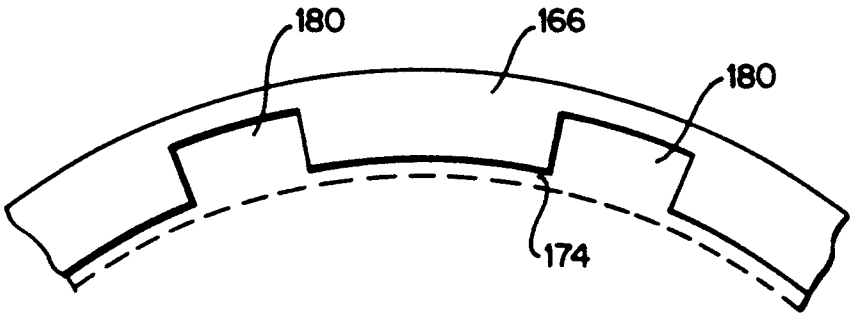

FLAME HOLDING DIVERGING CENTERBODY CUP CONSTRUCTION FOR A DRY LOW NOX COMBUSTOR

BACKGROUND AND SUMMARY OF THE INVENTION

The present invention relates to gas turbine combustors and, in particular, to improvements in gas turbine combustors capable of reduced nitrous oxides (NOx) emissions.

In an effort to reduce the amount of NOx in the exhaust gas of a gas turbine, a dual stage, dual mode combustor was developed by the assignee of this invention and disclosed in U.S. Pat. No. 4,292,801. In the aforementioned patent, it is disclosed that the amount of exhaust NOx can be greatly reduced, as compared with a conventional single stage, single fuel nozzle combustor, if there are two combustion chambers established such that, under conditions of normal operating load, the upstream primary combustion chamber performs as a premix chamber, while actual combustion occurs in the downstream secondary combustion chamber. Under this described operating condition, there is no flame in the primary chamber, and its premixed fuel and air is burned in the secondary chamber resulting in a decrease in the formation of NOx. In this condition, the secondary or center nozzle provides the flame source for the operation of the combustor. The specific configuration disclosed in the patent includes an annular array of primary nozzles, each of which discharges fuel into the primary combustion chamber, and a central secondary nozzle which discharges fuel into the second combustion chamber. In other words, the second stage centerbody acts as a pilot for premixed fuel and air passing from the first stage. In a later related development, which is the subject of U.S. Pat. No. 4,982,570 (also commonly assigned), the single central nozzle was replaced by a combined diffusion and premix nozzle which reduces fuel flow to the central diffusion flame from 20 percent of the total fuel flow to about 2 percent of the total fuel flow for the entire combustor. In this later development, the pilot is comprised of a small diffusion sub-pilot and premixed fuel and air, both fed from a secondary stage nozzle within the centerbody.

During premixed combustion, it is desirable for the flame from the second stage pilot to be stable at all times since flame instabilities result in high oscillatory (dynamic) pressure levels. These dynamic pressures may disturb combustor operations by shifting the flame into supposedly non-flame holding regions, i.e., they may create flashback. A more stable premixed pilot at all operating conditions would reduce dynamic pressures and improve the operating characteristics of the combustor and gas turbine.

The existing centerbody cup arrangements shown in the aforementioned U.S. Pat. Nos. 4,982,570 and 4,292,801 (both of which are incorporated herein by reference), generally include cylindrical centerbody cups with an air swirler around the outside diameter of the cup. In the '570 patent, the centerbody cup is shown, in one embodiment, to flare outwardly downstream of the secondary nozzle, but continues to utilize a swirler downstream of the diffusion and premix nozzle and surrounding the centerbody cup wall. The outer swirler columnates the flame for stability, but at the same time shields the flame from other flame holding devices. If the centerbody configuration is not properly designed, high dynamic pressure oscillations may occur at some operating conditions when the secondary nozzle supplying premixed fuel and air in the centerbody is operating. Since the secondary nozzle that supplies premixed fuel and air to the centerbody (as opposed to a more stable diffusion pilot secondary nozzle) is necessary to achieve low emissions levels, a modification of the centerbody in accordance with this invention, is the best method to produce a more stable pilot flame and achieve lower dynamic pressure levels.

The principal objective of this invention, therefore, is to alter the behavior (velocity and direction) of the premixed fuel and air passing through the centerbody cup to pilot the flame. In the original geometry, as described in the two above identified patents, the cup is cylindrical and the flow passing through it is kept that way by an outside layer of swirling air. The modification in accordance with the present invention is to expand the cup diameter into a diverging section, and to eliminate the outer air swirler. This greatly reduces the outer layer of air, and lowers the flow velocity (an equal mass flow through a larger area), while allowing for some radial dispersion of the fuel and air mixture as it leaves the centerbody cup, thereby creating a larger recirculation zone and thus a more stable flame. The diverging cup can also serve as a support for attaching flame holders. Thus, in accordance with this invention, the unique feature is primarily that flame stabilization is achieved without swirl air surrounding the flame. In the present configuration, the diverging centerbody cup is attached to a device which provides a swirled fuel/air mixture to the cup. The mixture burns as the flame is held in the cup, but is allowed to expand radially by the diverging cup as it progresses downstream. The result is a larger recirculation zone with the flame held closer to the cup, which in turn protects the flame, and thereby increases flame stability. At the same time, in place of the previously employed air swirler, a coolant manifold is located between the inner and outer cylindrical portions of the centerbody, diverting a small portion of the air flow through the centerbody to cool the exterior surface of the centerbody cup.

Thus, in accordance with each of the exemplary embodiments of the invention, a centerbody is provided which comprises a pair of cylindrical sections, the outer section being cooled or uncooled. A swirler, which interfaces with the discharge end of the diffusion and premix nozzle, is attached to the inner cylindrical section so as to provide a swirled fuel/air mixture to the cup during operation. Downstream of this inner swirler, a diverging cup portion is added to the inner cylindrical section. The diverging cup portion may have either a straight cone configuration, a curved conical surface or a variation or combination of the two.

The centerbody cup is cooled by impingement and/or film cooling air which passes through a coolant manifold located radially between the inner and outer cylindrical sections, and specifically between the centerbody cup and the outer cylindrical section.

In one embodiment, the diverging cup portion includes diverging end portions connected by a substantially cylindrical intermediate center portion. In this embodiment, the coolant manifold is located radially between and spaced from the centerbody cup and adjacent outer cylindrical section such that a rearward portion extends parallel to the upstream diverging portion of the centerbody cup, and a forward portion extends substantially parallel to the cylindrical intermediate portion of the centerbody cup. The forward end of the manifold remains substantially cylindrical, and thereby intersects the forward diverging end portion of the centerbody cup. At the same time, the rearward end of the manifold is secured to the centerbody cup by a closed annular wall. At a location intermediate the ends of the manifold, an annular wall extends between the coolant manifold and the outer cylindrical portion of the centerbody.

The manifold is provided with a first plurality of apertures upstream of the intermediate connecting wall and a second plurality of apertures downstream of the intermediate connecting wall while the latter is also provided with a third plurality of apertures. By this arrangement, air flowing axially in the annular space between the inner and outer sections of the centerbody will be caused to flow principally from the annular space through the first plurality of apertures in the manifold to a cooling chamber where the air impinges on the exterior surface of the centerbody cup. The air will then exit the cooling chamber through the second plurality of apertures (downstream of the intermediate connecting wall) and return to the space between the manifold and the outer cylindrical section for axial flow out of the centerbody thus providing film cooling. At the same time, a lesser portion of the air will flow directly through the third plurality of apertures in the intermediate connecting wall, bypassing the cooling chamber.

The exact number of apertures in each of the respective first, second and third plurality of chambers may be adjusted as desired to obtain the desired cooling, air flow, etc.

In a second exemplary embodiment, the centerbody cup has a uniformly conical shape, with a coolant manifold attached at its forward end. The manifold extends parallel to the cup, and axially beyond where it intersects the forward end of the outer cylindrical section which, unlike the first described embodiment, is substantially cylindrical along its entire length. In this arrangement, the connection between the forward end of the manifold and the outer cylindrical section may be closed, thus forcing all air to flow through a first plurality of apertures in the manifold to an open-ended cooling chamber, thus cooling the centerbody cup. Alternatively, an annular array of holes may be provided where the manifold intersects the outer cylindrical section so that at least some of the air can flow out of the space between the inner and outer centerbody sections without impinging on the inner centerbody cup. In this second exemplary embodiment, the outer cylindrical section may be film cooled along its entire length, providing additional flow paths out of the annular space between the centerbody inner and outer sections. Variations of the above described embodiments are also disclosed further herein.

In its broader aspects, therefore, the present invention relates to a centerbody construction for use in a gas turbine combustor comprising a pair of inner and outer generally cylindrical members, the inner member having a diverging cup portion attached to its forward end extending toward the outer cylindrical member, and a coolant manifold arranged between the inner and outer cylindrical members radially adjacent the centerbody cup portion.

The centerbody cup constructions of this invention have a number of advantages over the prior, known constructions. By eliminating the outer swirler and utilizing a diverging centerbody cup, the air/fuel mixture burns in the cup but expands radially as the flame progresses downstream. This creates a larger recirculation zone, with the flame held closer to the cup, thereby increasing flame stability. At the same time, a cooling arrangement for the centerbody cup is provided which also creates a barrier to flashback.

Other objects and advantages of the invention will become apparent from the detailed description which follows.

BRIEF DESCRIPTION OF THE DRAWINGS

FIG. 5 is an enlarged detail of a centerbody cup in accordance with a third embodiment of the invention;

FIG. 6 is partial front view of the centerbody cup shown in FIG. 5; and

DETAILED DESCRIPTION OF THE DRAWINGS

Figure 1:
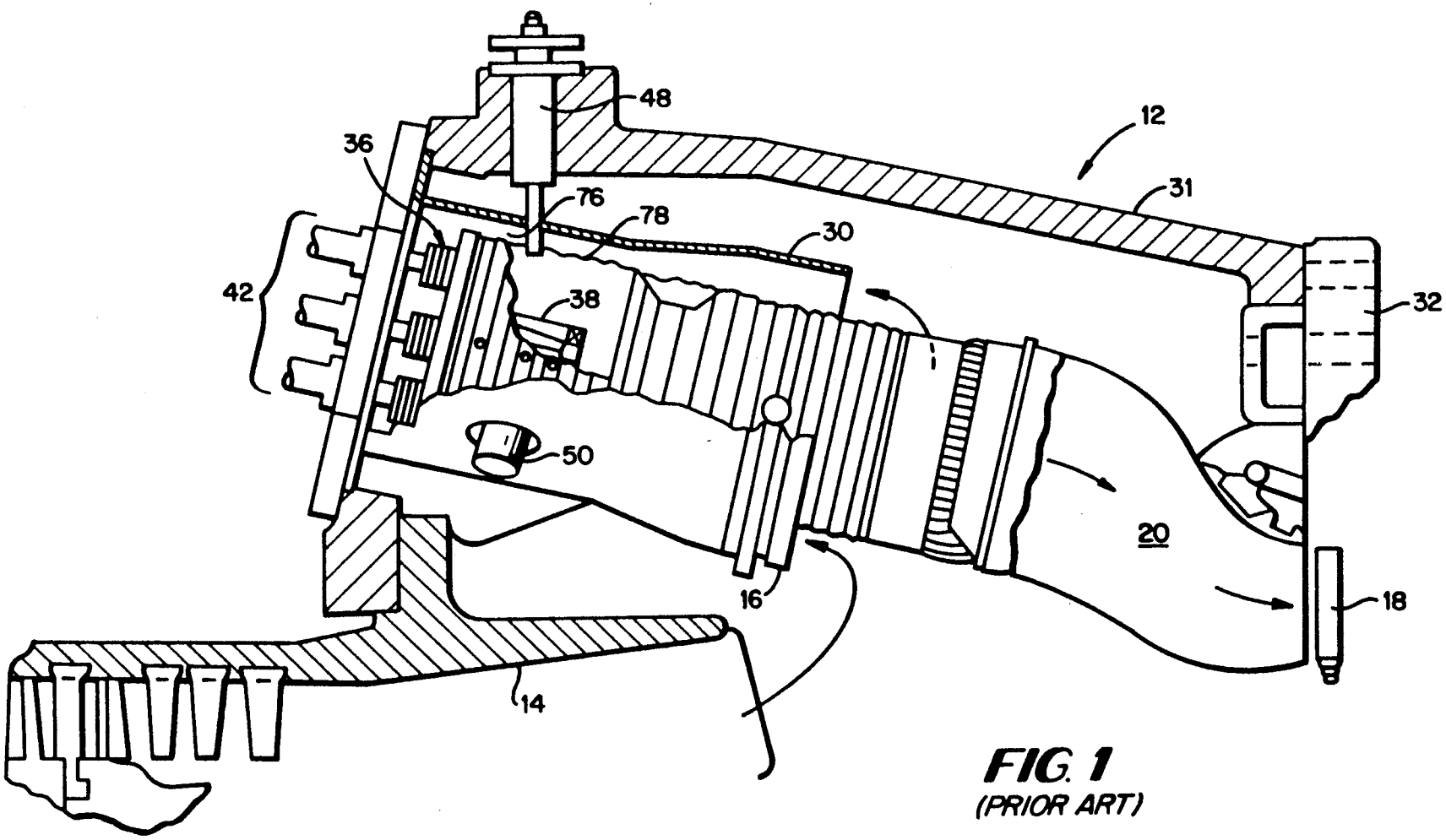
FIG. 1 (PRIOR ART)
FIG. 1 is an elevational view of a prior gas turbine engine shown in partial cross section.
Figure 2:
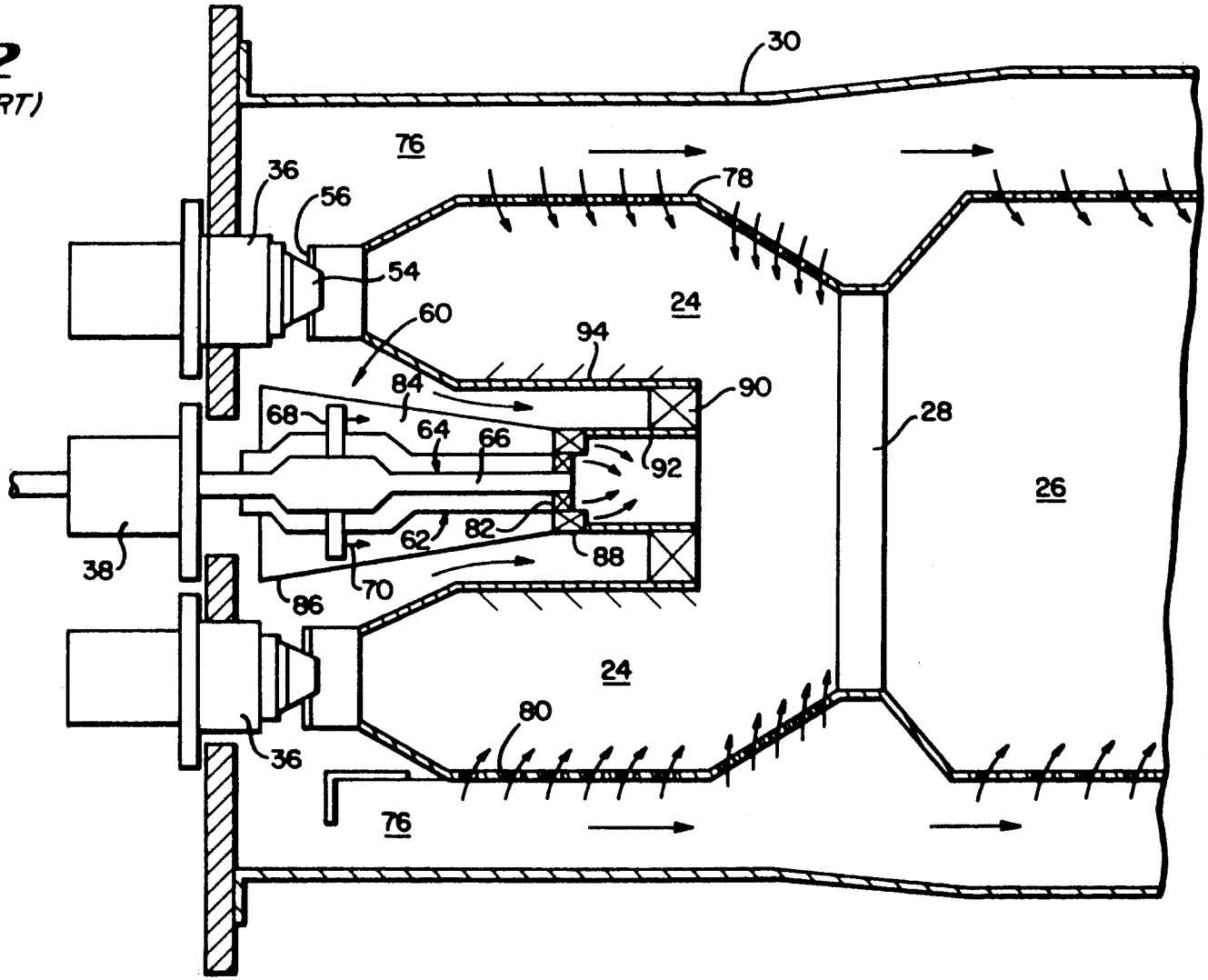
FIG. 2 (PRIOR ART)
FIG. 2 is an enlarged detailed elevation view of a combustor section of a gas turbine engine in accordance with a prior design.

Referring to FIGS. 1 and 2, a gas turbine 12 includes a compressor 14, a combustor 16 and a turbine 18 represented by a single blade. Although it is not specifically shown, it is well known that the turbine is drivingly connected to the compressor along a common axis. The compressor pressurizes inlet air which is then turned in direction or reverse flowed to the combustor where it is used to cool the combustor and also used to provide air to the combustion process. The gas turbine includes a plurality of combustors 16 (one shown) which are located about the periphery of the gas turbine. In one particular gas turbine model, there are fourteen such combustors disposed about the periphery of the gas turbine. A transition duct 20 connects the outlet end of its particular combustor with the inlet end of the turbine to deliver the hot products of combustion to the turbine.

The present invention is particularly useful in a dual stage, dual mode low NOx combustor of the type described in U.S. Pat. Nos. 4,292,801 and 4,982,570. As described in the latter patent, and as shown in FIG. 2, each combustor may comprise a primary or upstream combustion chamber 24 and a secondary or downstream combustion chamber 26 separated by a venturi throat region 28. The combustor is surrounded by combustor flow sleeve 30 which channels compressor discharge air flow to the combustor. The combustor is further surrounded by an outer casing 31 (FIG. 1) which is bolted to the turbine casing 32 (FIG. 1).

Primary nozzles 36 provide fuel delivery to the upstream combustor 24 and are arranged in an annular array around a central secondary nozzle 38. In one model gas turbine, each combustor may include six primary nozzles and one secondary nozzle. To complete the description of the combustor, fuel is delivered to the nozzles through conduits 42 (FIG. 1) in a manner well known in the art. The ignition in the primary combustor is caused by a sparkplug 48 (FIG. 1) and in adjacent combustors by means of cross-fire tubes 50 (FIG. 1) also in a manner well known in the art.

As shown in FIG. 2, and as described in U.S. Pat. No. 4,292,801, the primary nozzles may be of the diffusion type such as shown at 36, and include a fuel delivery nozzle 54 and an annular swirler 56. The nozzle 54 delivers only fuel which is then subsequently mixed with swirler air for combustion. In the '570 patent, and as also shown in FIG. 2 herein, the secondary nozzle 38 is disclosed as a combined diffusion and premix nozzle. The combined nozzle includes a diffusion pilot 62 having a fuel delivery pipe 64. The fuel delivery pipe includes an axial pipe 66 and a plurality of radial, blind ended premixed fuel distribution tubes 68 which extend radially outwardly from the axial pipe. The fuel distribution tubes each include a plurality of fuel discharge holes (indicated generally by arrows 70) which are directed downstream toward the discharge end of the combined nozzle. The fuel distribution holes are sized so as to obtain the desired percentage of fuel flow into the premix chamber. The diffusion pilot 62 further includes an air delivery pipe 74 coaxial with and surrounding the fuel delivery axial pipe 66. The air input into the air delivery pipe is compressor discharge air which is reverse flowed around the combustor into the volume 76 defined by the flow sleeve 30 in the combustion chamber liner 78. The diffusion pilot includes at its discharge end a first swirler annulus or diffusion pilot swirler 82 for the purpose of directing air delivery pipe discharge air to the diffusion pilot flame.

A premix chamber 84 is defined by a sleeve-like truncated cone 86 which surrounds the downstream portion of the secondary nozzle and includes a discharge end terminating adjacent the diffusion pilot discharge end. Compressor discharge air is also reverse flowed into the premix chamber from volume 76 in a manner similar to the air delivery pipe. The plurality of radial fuel distribution tubes 68 extend through the air delivery pipe 74 and into the premix chamber annulus such that the fuel and air are mixed and delivered to a second swirler or premix chamber swirler 88 between the diffusion pilot and the premix chamber truncated cone 86.

A third or outer swirler 90 is located downstream from the discharge end of the combination diffusion and premix nozzle. This swirler is located between a centerbody cup 92 on the discharge end of the pilot and the centerbody wall 94 of the primary combustion chamber. Compressor air is also reverse flowed to this swirler from the volume 76 surrounding the combustion liner. The purpose of this third swirler is to provide stability for the diffusion and premix nozzle flame when combining with the primary premix flow from the primary combustor.

Figure 3:
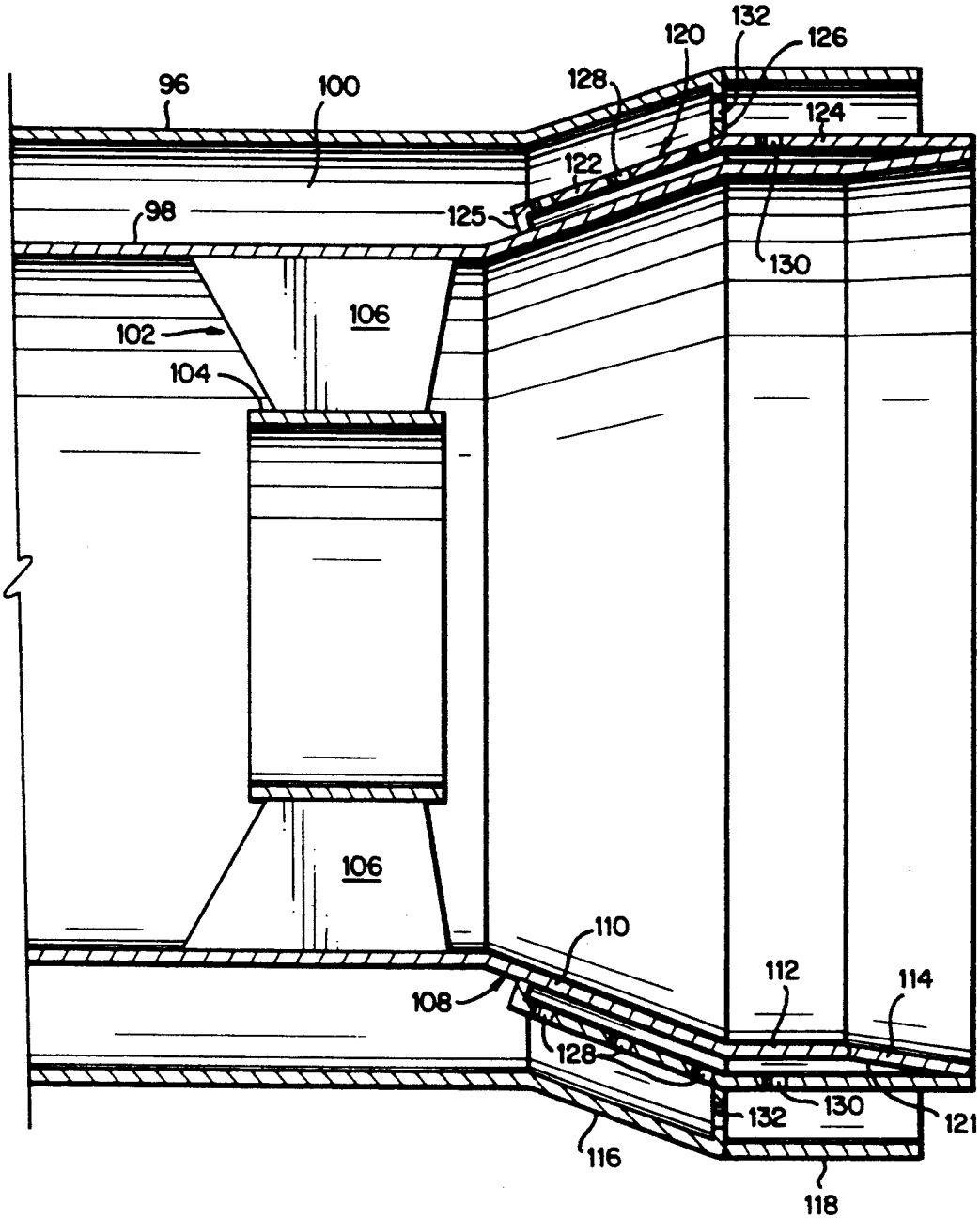
FIG. 3 is an enlarged detailed elevation of a centerbody cup (with fuel nozzle removed for clarity) in accordance with this invention shown in partial cross-section.

Turning now to FIG. 3, the improved arrangement in accordance with one exemplary embodiment of this invention is shown to include a nozzle centerbody comprising a pair of concentrically arranged cylindrical members 96, 98 (corresponding to walls 94, 86 in FIG. 2) which establish an annular air chamber 100 for receiving compressor discharge air from the volume 76 (see FIGS. 1 and 2). The inner cylindrical member 98 is provided with a swirler 102, similar to swirler 88 (FIG. 2), including a central sleeve 104 for interfacing with the discharge end of a fuel nozzle (not shown for purposes of clarity). Swirler 102 includes a plurality of swirler vanes 106 which serve to swirl the air/fuel mixture from the premix chamber 84 (FIG. 2).

In accordance with this first exemplary embodiment of the invention, a centerbody cup 108 is attached to the forward end of the inner cylindrical member 98 and includes a diverging wall portion 110, a generally cylindrical wall portion 112, and a diverging wall portion 114 at its downstream end. At the same time, the outer cylindrical member 96 is provided with an diverging portion 116 and a generally cylindrical portion 118 in substantially concentric arrangement with the centerbody cup 108. A coolant manifold 120 is provided between the centerbody cup 108 and the wall portions 116, 118 of the outer cylindrical member 96, establishing a cooling chamber 121. The manifold 120 includes a diverging section 122 and a generally cylindrical portion 124 which may be attached at its forwardmost edge to the edge of cup wall portion 114. The rearward portion of the manifold 120 engages the diverging portion 110 of the cup 108 with a wall portion 125 extending perpendicularly to the wall 110 as best seen in FIG. 3. At the same time, the coolant manifold 120 is connected to the outer cylindrical member 96 at the intersections of wall portions 116, 118 by an annular wall 126 extending from the manifold 120 at a location intermediate the rearward and forward ends thereof. The diverging portion 122 of manifold 120 is provided with a first plurality of coolant apertures 128 lying upstream of the wall 126 and a second plurality of apertures 130 lying downstream of the wall 126. The annular wall 126 is provided with a third plurality of apertures 132. It will be appreciated that the first, second and third pluralities of apertures 128, 130 and 132 are arranged in circumferentially spaced relationship within their respective surfaces or walls 122, 124 and 126.

Some air flowing through the annular chamber 100 will flow out of the centerbody via the third plurality of apertures 132. At the same time, however, a major portion of the air will be diverted into the first plurality of apertures 128 and will flow along the exterior surface of the centerbody cup 108 to exit via the downstream second plurality of apertures 130 in the cylindrical wall portion 124 of the coolant manifold 120. In this way, the centerbody cup 108 is cooled by impingement air, and at the same time, a barrier to flashback is created by the air exiting between walls 118 and 124.

As will be appreciated from the above description, the outer swirler 90 described hereinabove in conjunction with the construction shown in FIG. 2, has been eliminated from the centerbody construction in accordance with the present invention. Thus, while the mixture burns as the flame is held in the cup 108, it is allowed to expand radially by the diverging cup as it progresses downstream. The result is a larger recirculation zone with the flame held closer to the cup, which in turn protects the flame, therefore increasing its stability.

To further increase the cooling of the cup, it will be appreciated that the diverging portion 114 of cup 108 may be removed, thus permitting the cooling air within the cooling chamber 121 to pass out of the centerbody in a modified cooling pattern, thus film cooling a portion of cylindrical wall 124.

It will be appreciated that the number and arrangement of apertures in the first, second and third pluralities of apertures 128, 130, 132, respectively, may be chosen in accordance with air flow/cooling requirements, and are not limited to the exemplary arrangements shown herein.

Figure 4:
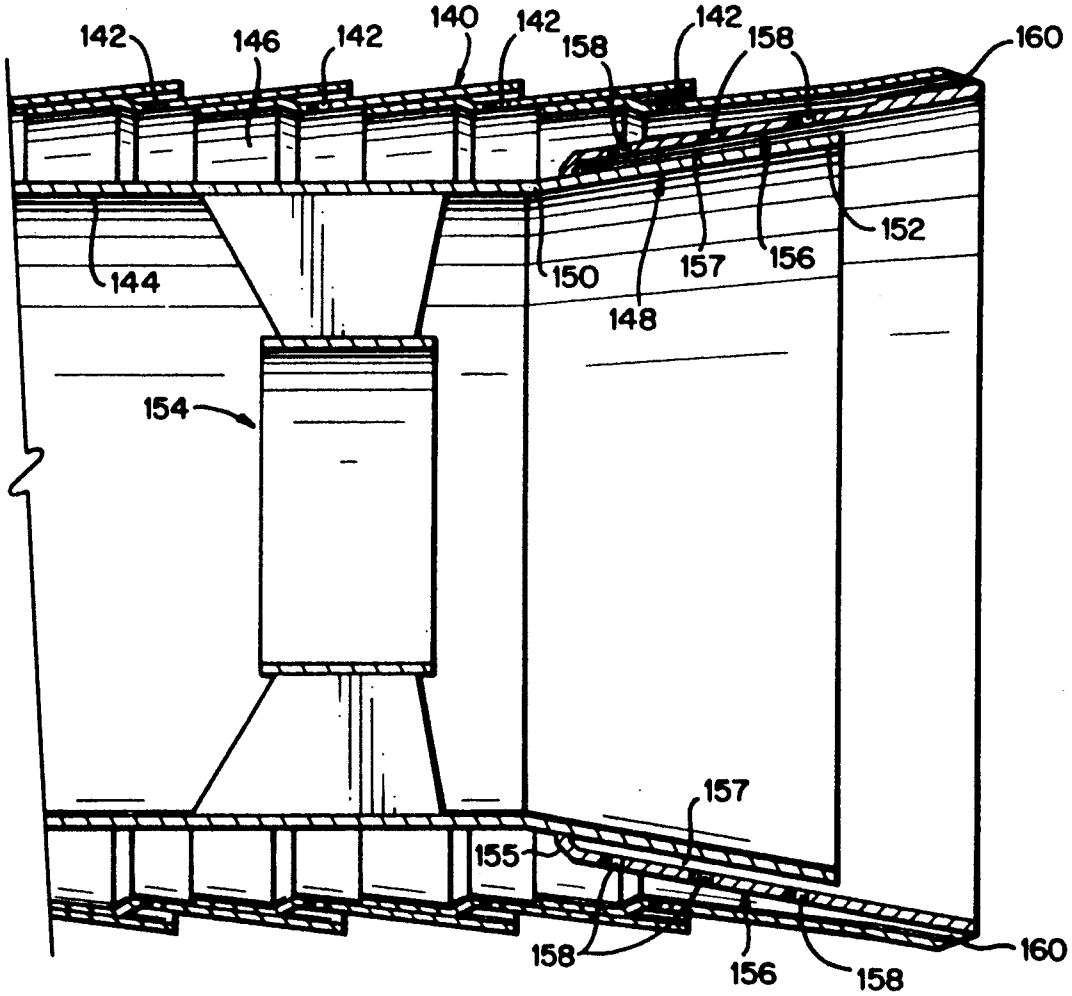
FIG. 4 is an enlarged detailed elevation of a centerbody cup (with fuel nozzle removed for clarity) in accordance with a second embodiment of the invention, also shown in partial cross-section.

Turning now to FIG. 4, a centerbody cup construction in accordance with a second exemplary embodiment of the invention is disclosed. This centerbody construction utilizes a film cooled outer cylindrical member 140 formed with a plurality of slots or apertures 142 arranged both axially and circumferentially. The outer cylindrical member also remains substantially cylindrical throughout its length, with only a slight outward flare at its downstream end. Between the inner and outer cylindrical members 140 and 144, there is formed an annular air chamber 146 through which air flows from volume 76 (see FIG. 2). The inner cylindrical member 144 has a centerbody cup 148 which diverges uniformly from rearward end 150 to forward end 152. As in the previously described embodiment, an inner swirler 154 is centrally located within the inner cylindrical member 144 (the fuel nozzle has again been removed for clarity).

An annular cooling manifold 156 extends about the centerbody cup 148 and axially beyond the cup to the forward tip of the outer cylindrical member 140 where it is attached to the latter. The manifold 156 is connected by a rearward wall 155 to the cup 148, such that the manifold is radially spaced from both the centerbody cup 148 and the outer cylindrical member 140, forming an annular cooling chamber 157 between the manifold and the centerbody cup.

A first plurality of holes 158 are provided in an annular array in the manifold 156. A second plurality of holes 160 are provided in circumferentially spaced relationship where the manifold 156 is joined to the outer cylindrical member 140 at its forwardmost edge.

By the above described arrangement, a portion of the air flowing through annular chamber 146 (from volume 76—see FIG. 2) will flow through apertures 158 into chamber 157 where it impinges on, and cools, the centerbody cup 148. The remaining air will flow out of chamber 146 via holes 160, bypassing the cooling chamber 157. Here again, the number, shape and size of the first and second pluralities of holes 158, 160 may be varied to suit specific applications of the invention.

With respect to the embodiment illustrated in FIG. 5, still another arrangement is illustrated wherein an annular coolant manifold 162 forward end 164 is closed by an annular wall 166 extending between the coolant manifold and the outer cylindrical member 168, while the rearward end 170 is connected to the centerbody cup 172. In this variation, the centerbody cup 172 extends axially beyond the outer cylindrical member 168 and manifold 162, so that the cooling slot or chamber 174 extends only partially along the centerbody cup 172. A first plurality of holes 176 are formed in an annular array within the annular manifold 162 and, because of the presence of closed wall 166, all air flowing through annular chamber 178 is forced to flow through holes 176 to the cooling chamber 174 where it is directed along the exterior surface of the centerbody cup 172. In the event that it is determined to be desirable that some air escape the chamber 178 without having to flow through apertures 176, the annular wall 166 may be constructed as illustrated in FIG. 6 with, for example, ten equally spaced slots or apertures 180 formed therein, allowing some air to bypass the coolant manifold 162.

Figure 7:
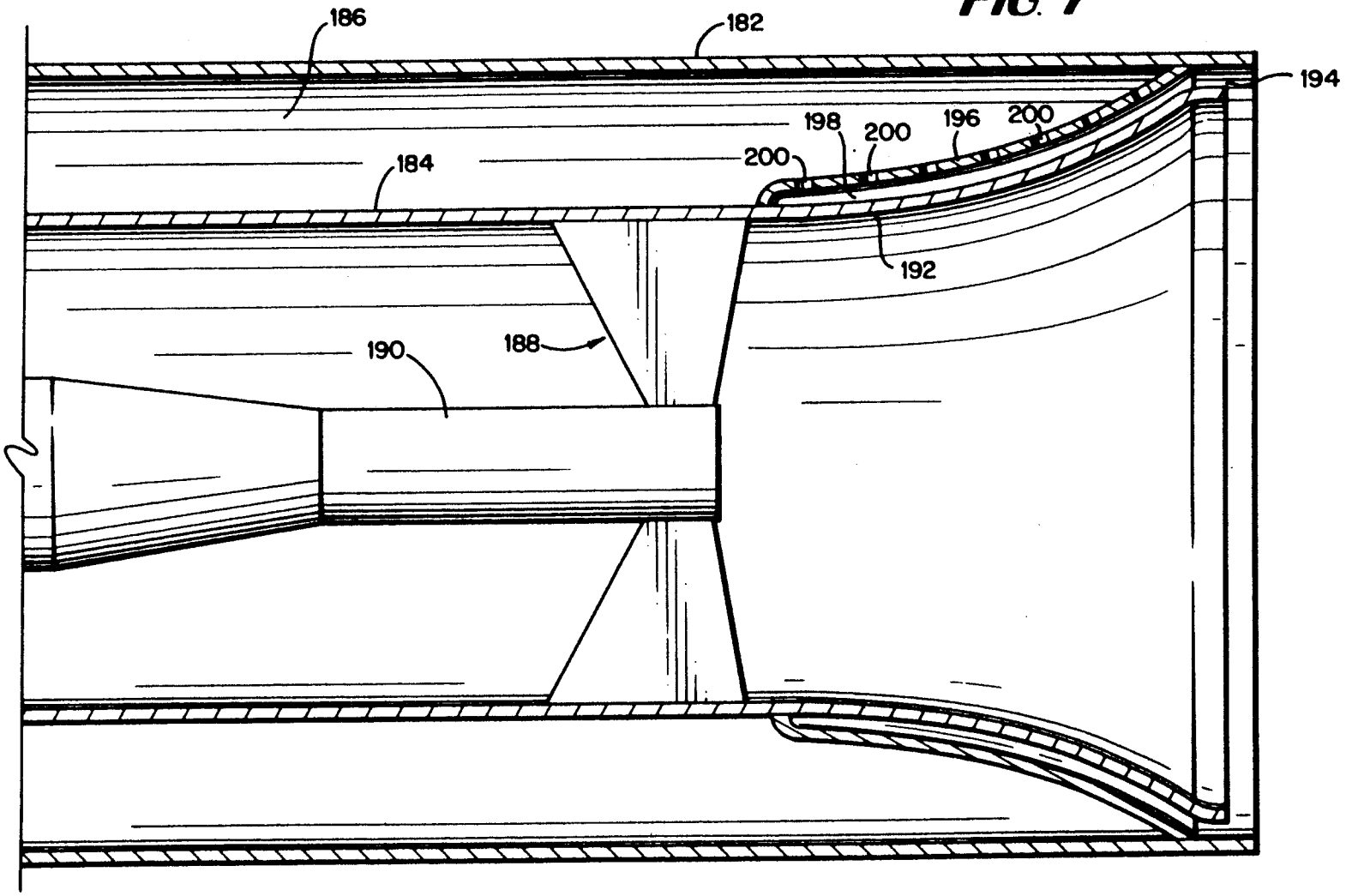
FIG. 7 is a an enlarged detailed elevation of a centerbody cup in accordance with a fourth embodiment of the invention.

Referring now to FIG. 7, the centerbody comprises, in a further embodiment, an outer cylindrical member 182 and an inner cylindrical member 184, defining an air chamber 186 therebetween. An inner swirler 188 is secured within the inner cylindrical member, interfacing with the forward end of a fuel nozzle 190.

A centerbody cup 192 is provided (integrally or attached) to the forward end of the member 184, curving substantially uniformly outwardly toward the outer cylindrical member 182 and terminating at an annular slot 194.

A coolant manifold 196, curved substantially in the same manner as the centerbody cup 192, extends between the rearward end of cup 192 and the forward end of outer cylindrical member 182, forming an annular cooling chamber 198. A first plurality of apertures 200 is provided in an annular array within the manifold 196 such that all air flowing through chamber 186 is forced to flow through apertures 200 into the chamber 198 and to impinge on the centerbody cup 192 along the full length thereof, before exiting the centerbody via slot 194.

In each of the above described embodiments, dynamic pressure levels are reduced in several ways. First, the expanded centerbody cup allows for larger recirculation. Second, the expanded cup has more area to anchor the flame and more volume for the fuel and air to mix as they pass radially outwardly. Third, in the absence of an outer swirler radial flame propagation to other flameholders is not inhibited. Fourth, the presence of the surrounding coolant air creates a barrier to flashback.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a gas turbine including a plurality of dry low NOx combustors, each combustor having a primary combustion chamber and a secondary combustion chamber, with a plurality of primary fuel nozzles for providing fuel to the primary combustion chamber arranged about a centrally located secondary nozzle for providing fuel to said secondary combustion chamber, the improvement comprising a flame holding diverging centerbody cup located radially between said primary fuel nozzles and said secondary fuel nozzle, said centerbody cup comprising a pair of inner and outer substantially cylindrical members, the inner substantially cylindrical member having a diverging cup portion attached to its forward end extending toward said outer cylindrical member, and a coolant manifold arranged radially between and connected to said outer cylindrical member and said diverging cup portion, said manifold having a portion extending substantially parallel to said diverging cup portion and provided with a plurality of coolant apertures, thereby forming an annular cooling chamber between said manifold and said diverging cup portion.

2. The centerbody cup construction of claim 1 wherein said inner substantially cylindrical member is provided with a swirler adapted to interface with a forward end of a secondary fuel nozzle.

3. The centerbody construction of claim 1 wherein said coolant manifold includes a wall which engages said diverging cup portion at two axially spaced locations, and is radially spaced therefrom between said axially spaced locations.

4. The centerbody construction of claim 1 wherein said coolant manifold is connected to said outer member by an annular wall at a location intermediate to said axially spaced locations.

5. The centerbody construction of claim 4 wherein said manifold is provided with coolant apertures on either side of said annular wall.

6. The centerbody construction of claim 5 wherein said annular wall includes at least one coolant aperture.

7. A flame holding diverging centerbody cup construction for a dry low NOx combustor comprising a pair of inner and outer substantially cylindrical members, the inner member having a diverging cup portion attached to its forward end extending toward said outer cylindrical member, and a coolant manifold arranged radially between said outer cylindrical member and said centerbody diverging cup portion, and substantially parallel to said diverging cup portion, thereby forming an annular cooling chamber between said manifold and said diverging cup portion wherein said coolant manifold includes a wall which engages said diverging cup portion at its rearward end, and said outer cylindrical member at its forward end.

8. The centerbody construction of claim 7 wherein at least one aperture is provided at an interface of said manifold and the forward end of the outer cylindrical member.

9. The centerbody construction of claim 7 wherein said coolant manifold is provided with a plurality of coolant apertures between said rearward and forward ends.

10. In a gas turbine including a plurality of dry low NOx combustors, each combustor having a primary combustion chamber and a secondary combustion chamber, with a plurality of primary fuel nozzles for providing fuel to the primary combustion chamber arranged about a centrally located secondary nozzle for providing fuel to said secondary combustion chamber, the improvement comprising a flame holding diverging centerbody cup located between said primary fuel nozzles and said secondary fuel nozzle, said centerbody cup comprising a first outer cylindrical member having a first outwardly flared downstream end; a second inner cylindrical member having a second outwardly flared downstream end radially adjacent said first outwardly flared downstream end; and means located radially between and substantially parallel to said first and second outwardly flared downstream ends for cooling said second outwardly flared downstream end.

11. The construction of claim 10 wherein said means is effective to divert at least some portion of air flowing between the first and second cylindrical members radially towards said second outwardly flared downstream end.

12. In a gas turbine including a plurality of dry low NOx combustors, each combustor having a primary combustion chamber and a secondary combustion chamber, with a plurality of primary fuel nozzles for providing fuel to the primary combustion chamber and arranged about a centrally located secondary nozzle for providing fuel to said secondary combustion chamber, the improvement comprising a flame holding diverging centerbody cup located between said primary fuel nozzles and said secondary fuel nozzle, said centerbody cup comprising:

a first outer generally cylindrical member having a first downstream end;

a second inner generally cylindrical member including a centerbody cup having a second outwardly flared downstream end, said second inner generally cylindrical member being arranged substantially concentrically relative to said first outer generally cylindrical member to thereby form an annular air flow chamber therebetween; and a cooling manifold located radially between said first and second members at said downstream ends, said manifold including at least one aperture arranged to divert at least a portion of air in said annular air flow chamber to impingement cool and outer surface of said centerbody cup.

13. The centerbody construction of claim 12 wherein said second inner generally cylindrical member is provided with a swirler adapted to interface with a forward end of a centerbody fuel nozzle.

14. The centerbody construction of claim 12 wherein said coolant manifold includes a wall which engages said centerbody cup at two axially spaced locations, and is radially spaced therefrom between said axially spaced locations.

15. The centerbody construction of claim 12 wherein said coolant manifold is connected to said outer cylindrical member by an annular wall located intermediate said axially spaced locations.

16. The centerbody construction of claim 15 wherein said manifold is provided with coolant apertures on either side of said annular wall.

17. The centerbody construction of claim 16 wherein said annular wall includes at least one coolant aperture.

18. A flame holding diverging centerbody cup construction for use in a dual stage, dual mode dry low NOx combustor comprising:

a first outer generally cylindrical member having a first downstream end;

a second inner generally cylindrical member including a centerbody cup having a second outwardly flared downstream end, said second inner generally cylindrical member being arranged substantially concentrically relative to said first outer generally cylindrical member to thereby form an annular air flow chamber therebetween; and a cooling manifold located radially between said first and second members at said downstream ends, said manifold including at least one aperture arranged to divert at least a portion of air in said annular air flow chamber to impingement cool an outer surface of said centerbody cup;

wherein said cooling manifold includes a wall which engages said centerbody cup at its rearward end, and said outer cylindrical member at its forward end, axially downstream of said centerbody cup engagement.

19. The centerbody construction of claim 18 wherein at least one aperture is provided at an interface of said manifold and the forward end of the outer cylindrical member.

20. The centerbody construction of claim 18 wherein said cooling manifold is provided with a plurality of coolant apertures between said rearward and forward ends.

* * * * *